US006749981B2

(12) United States Patent
Nakajima et al.

(10) Patent No.: US 6,749,981 B2
(45) Date of Patent: Jun. 15, 2004

(54) INK SHEET, RECORDING MEDIUM AND RECORDING METHOD FOR LASER THERMAL TRANSFER RECORDING

(75) Inventors: Atsushi Nakajima, Hino (JP); Katsumi Maejima, Hino (JP)

(73) Assignee: Konica Corporation, Tokyo (JP)

( * ) Notice: Subject to any disclaimer, the term of this patent is extended or adjusted under 35 U.S.C. 154(b) by 39 days.

(21) Appl. No.: 10/104,182

(22) Filed: Mar. 22, 2002

(65) Prior Publication Data

US 2002/0146637 A1 Oct. 10, 2002

Related U.S. Application Data

(62) Division of application No. 09/460,215, filed on Dec. 13, 1999, now abandoned.

(30) Foreign Application Priority Data

Dec. 18, 1998 (JP) ..... 10-375927

(51) Int. Cl.[7] ..... B41M 5/30

(52) U.S. Cl. ..... 430/200; 430/201; 430/945; 347/212; 347/215; 347/216; 347/220; 347/262; 347/264

(58) Field of Search ..... 430/200, 201, 430/945; 156/234; 347/212, 215, 216, 220, 137, 264, 262

(56) References Cited

U.S. PATENT DOCUMENTS 4,826,717 A 5/1989 Kohashi et al. ..... 428/43
5,072,238 A * 12/1991 Takamiya et al. ..... 346/135 PH
5,133,820 A * 7/1992 Katayama et al. ..... 156/234
5,441,794 A 8/1995 Hitomi et al. ..... 428/195
5,501,937 A 3/1996 Matsumoto et al. ..... 430/200

FOREIGN PATENT DOCUMENTS

| | | |
|---|---|---|
| EP | 0 739 749 | 10/1996 |
| JP | 56-164891 | 12/1981 |
| JP | 01-042259 | * 2/1989 |
| JP | 02-025382 | 1/1990 |
| JP | 08-267916 | 10/1996 |
| JP | 08-290680 | 11/1996 |

OTHER PUBLICATIONS

Machine translation of JP 08–029680.*
Handbook of Chemistry and Physics, 63rd Ed. (1983) pp. B–74, B–109 and B–143.

* cited by examiner

*Primary Examiner*—Martin Angebranndt
(74) *Attorney, Agent, or Firm*—Frishauf, Holtz, Goodman & Chick, P.C.

(57) ABSTRACT

A laser thermal transfer recording method is disclosed. The method employs an ink sheet having a light-heat conversion layer an a laser thermal transfer image receiving sheet having an image receiving layer in which Vicat softening point of the resin composing the thermoplastic layer of the image receiving layer is less than 80° C., and one of the image receiving layer and the ink layer contains a matting agent having a particle diameter larger than the thickness of the layer containing matting agent, the projection height of the matting agent is less than 3.5 $\mu$m and the frequency of the projections is from 400/mm$^2$ to 4,000/mm$^2$, and the peeling angle of the ink sheet and the image receiving sheet is controlled at an angle less than 30°.

4 Claims, 3 Drawing Sheets

Figure 1:
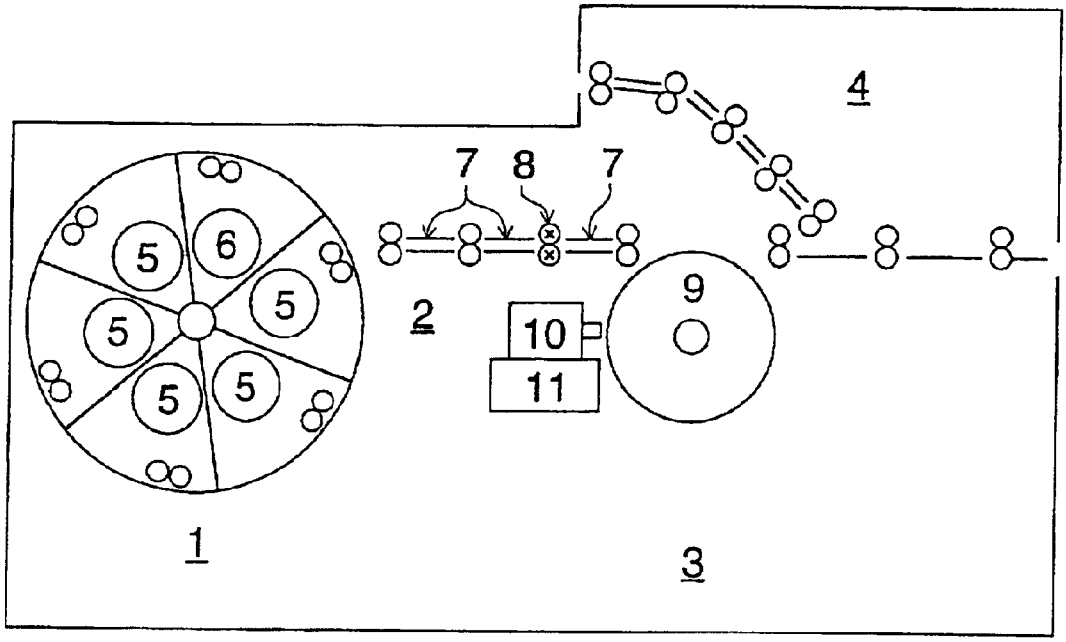

INK SHEET, RECORDING MEDIUM AND RECORDING METHOD FOR LASER THERMAL TRANSFER RECORDING

This application is a division of application Ser. No. 09/460,215 filed on Dec. 13, 1999, now abandoned.

FIELD OF THE INVENTION

This invention relates to an ink sheet, a recording medium and a recording method for laser thermal transfer recording, particularly relates to an ink sheet, a recording medium and a recording method for laser thermal transfer recording by which peeling for development can be stably carried out within a relatively wide range of the peeling condition.

BACKGROUND OF THE INVENTION

Recently, a need for direct digital color proof (DDCP) is raised in the field of printing accompanied with widespreading of the image forming technology using digital data. In the DDCP process, high color reproducibility and a stable repeatability are required.

The transferring ability of an ink layer is varied according to peeling conditions, such as a temperature change of the thermal recording medium caused by time passing after the thermal transfer, a peeling speed and a peeling angle, of the thermal transfer recording medium. Therefore, the transfer is made unstable when the peeling condition is unstable.

The influence of the conditions is made larger when the peeling is carried out with a small peeling angle after cooling the thermal transfer medium by leaving for a time after the thermal transfer in a high resolution laser thermal transfer recording process. In such the case, the unevenness of the peeling conditions tends to directly cause a defect such as density unevenness.

Moreover, the transfer at a part exposed to a weak laser light is not easily occurred when the peeling angle is insufficient. Accordingly, such the part is not transferred and a reed screen-like defect in the direction of laser scanning is caused.

For avoiding such the problem, a material is used for improving the peeling ability between the ink layer and the light-heat conversion layer, cf. Japanese Patent Publishing Open to Public Inspection (JP-A) No. 8-267916, and a peeling roller having a relative small diameter is used for fixing the peeling conditions with a large peeling angle as possible.

However, an unevenness of peeling tends to be formed in a high energy recording process using a usual recording material and a usual inter transfer recording medium, since the force necessary for peeling is raised in such the case. On the other hand, some problems are caused such as the apparatus is made complex or an image damage is caused by the transporting with a large curvature, when the peeling roller is used.

The use of the peeling roller having a simple peeling guide is advantageous for reducing the cost and preventing a trouble in the course of transportation. In such the case, it is needed to improve the recording materials so that the peeling development thereof is not dependent on the peeling conditions.

It is found that the peeling development can stably be performed within a relative wide range of the peeling condition by selecting the physical properties of the ink sheet and the inter-transfer medium or image receiving sheet, and this invention is attained.

SUMMARY OF THE INVENTION

The object of the invention is to provide an ink sheet, a recording medium and a recording method for laser thermal transfer recording by which peeling for development can be stably carried out within a relative wide range of the peeling condition within a relative broad region.

It has been found that providing a thermoplastic layer and selecting matting agent improve the close contact of the sheets mutually as well as peeling characteristics.

The invention and its embodiments are described below.

A laser thermal transfer recording method of the invention comprises the following steps,

- superposing a laser thermal transfer ink sheet having a light-heat conversion layer and an ink layer on a laser thermal transfer image receiving sheet having a thermoplastic layer and an image receiving layer;
- contacting with a vacuum a surface of the ink layer of the ink sheet with the surface of the image receiving layer of the image receiving sheet;
- thermally transferring a part of the ink layer to the image receiving layer by light-heat conversion of laser light irradiated from the ink layer side; and
- peeling off the ink sheet from the image receiving sheet,
- wherein Vicat softening point of the resin of the thermoplastic layer is not more than 80° C., and one of the image receiving layer and the ink layer contains a matting agent having a particle diameter larger than the thickness of the layer containing matting agent, the projection height of the matting agent is less than 3.5 $\mu$m and the frequency of the projections is from 400/mm$^2$ to 4,000/mm$^2$, and peeling angle of the ink sheet and the image receiving sheet is controlled at an angle less than 30°.

It is preferred that the laser thermal transfer ink sheet and the laser thermal transfer image receiving sheet are superposed on a drum, laser light is irradiated in the condition of superposed state on the drum, and the peeling angle is an angle between tangential direction of the drum and direction of the ink sheet during peeling.

The ink layer preferably comprises a thermoplastic resin having a dry bulb softening point of from 60 to 150° C. in an amount of 65% to 95% by weight, and the thickness of the ink layer is preferably 0.3 to 0.7 $\mu$m.

The ink layer preferably comprises at least two kinds of thermoplastic resin having a dry bulb softening point of from 60 to 150° C. and difference of the softening point of thermoplastic resin having the highest softening point and that of thermoplastic resin having the lowest softening point is from 20° to 80° C.

A laser thermal transfer recording medium comprises a laser thermal transfer ink sheet having a support, a light-heat conversion layer and an ink layer, an image receiving sheet having a thermoplastic resin layer and an image receiving layer capable of receiving a part of the ink layer, wherein a thermoplastic resin layer comprises a resin having Vicat softening point of not more than 80° C., one of the image receiving layer and the ink layer contains a matting agent having a particle diameter larger than the thickness of the layer containing matting agent, the projection height of the matting agent is less than 3.5 $\mu$m, and the frequency of the projections is from 400/mm$^2$ to 4,000/mm$^2$.

The laser thermal transfer ink sheet according to the invention comprises at least a light-heat conversion layer and an ink layer is used, in which the ink layer contains a thermoplastic resin having a softening point of from 60 to 150° C. in an amount of from 65% to 95% by weight, and has a thickness of 0.3 to 0.7 $\mu$m.

In the above-mentioned, it is preferable that the thermoplastic having a dry bulb softening point of from 60 to 150° C. is composed of a combination of two or more kinds of thermoplastic resin and the difference of the softening point of the thermoplastic resin having the highest softening point and that of the thermoplastic resin having the lowest softening point is within the range of from 20 to 80° C.

The ink layer preferably contains a matting agent having a particle diameter larger than the thickness of the ink layer, the projection height of the matting agent is less than 3.5 $\mu$m, and the frequency of the projections is within the range of from 400/mm$^2$ to 4000/mm$^2$.

A medium for laser thermal transfer recording according to the invention preferably comprises an ink sheet for laser thermal transfer comprising a light-heat conversion layer and an ink layer, and an image receiving sheet for laser thermal transfer comprising a thermoplastic resin layer and an image receiving layer capable of receiving the ink layer of the ink sheet, wherein the thermoplastic resin of the thermoplastic resin layer has a Vicat softening point of not more than 80° C., and one of the image receiving layer and the ink layer contains a matting agent having a particle diameter larger than the thickness of the layer containing the matting agent, the projection height of the matting agent is less than 3.5 $\mu$m and the frequency of the projections is within the range of from 400/mm$^2$ to 4000/mm$^2$.

It is preferably that the ink sheet having an ink layer comprising a thermoplastic resin having a dry bulb softening point of from 60 to 150° C. in an amount of 65% to 95% by weight and a layer thickness of from 0.52 g/m$^2$ to 0.90 g/m$^2$ is used and the peeling angle is set at an angle of less than 30°.

The thermoplastic resin having a dry bulb softening point of from 60 to 150° C. composed of two or more kinds of thermoplastic resin and the difference of the softening point of the thermoplastic resin having the highest softening point and that of the thermoplastic resin having the lowest softening point is from 20° to 80° C.

A laser thermal transfer recording method according to the invention comprises the steps of contacting with a vacuum the surface of ink layer of the laser thermal transfer ink sheet having a light-heat conversion layer and an ink layer with the surface of image receiving layer of a laser thermal transfer image receiving sheet having an image receiving layer capable of receiving the ink of the ink layer; thermally transferring the ink layer to the image receiving layer by light-heat conversion of laser light irradiated from the ink layer side; and peeling off the ink sheet from the image receiving sheet after sufficiently releasing heat to form a thermally transferred image on the image receiving sheet, wherein a recording medium is used, in which the Vicat softening point of the resin composing the thermoplastic layer of the image receiving layer is less than 80° C., and one of the image receiving layer and the ink layer contains a matting agent having a particle diameter larger than the thickness of the matting agent containing layer, the projection height of the matting agent is less than 3.5 $\mu$m and the frequency of the projections is from 400/mm$^2$ to 4,000/mm$^2$, and the peeling angle of the ink sheet and the image receiving sheet is controlled at an angle less than 30° by a device such as a peeling guide and a peeling roller.

DETAILED DESCRIPTION OF THE INVENTION

An example of exposure apparatus usable in the invention is described according to FIG. 1.

In FIG. 1, 1 shows a materials storing portion of laser thermal transfer ink sheet and the image receiving sheet, 5 is an ink sheet storing portion and 6 is an image receiving sheet storing portion.

In the FIG., 2 shows a material supplying portion through which the image receiving sheet and the ink sheet are supplied to an exposing drum 9. 7 is a guide plate for transporting the image receiving sheet and the ink sheet, 8 is an adhesive roller for removing dusts adhered on the image receiving sheet and the ink sheet. 3 is the exposing portion, in which a laser head 10 and laser head carriage 11 are arranged.

First, the image receiving sheet is supplied from the image receiving sheet storing portion 6 and winded on the exposure drum 9 so that the image receiving surface is outside. Next, the ink sheet supplied from the ink sheet storing portion 5 is winded on the exposure drum 9 so that the surface of the ink layer is contacted with the image receiving surface of the image receiving sheet winded on the exposure drum 9, and exposed to laser light emitted from the laser head 10. The colorant of the ink layer is transferred to the image receiving sheet by the exposure to form an image on the image receiving sheet.

In FIG. 1, 4 is a discharge portion where the image receiving sheet and the ink sheet are discharged after exposure. In the discharge portion 4, the ink sheet after exposure is discharged to the backside (the right side in the figure) of the apparatus, then the image receiving sheet, on which an image is formed, is discharged. The image receiving sheet is once transported in the horizontal direction and then the direction is changed so that the sheet is discharged to the upper left direction as shown in the figure. The direction change is effective for preventing damage formation on the image receiving surface.

The laser thermal transfer recording medium according to the invention includes the laser thermal transfer ink sheet and the laser thermal transfer image receiving sheet. Of course, one in which the ink sheet and the image receiving sheet are unified is the laser thermal transfer recording medium according to the invention. A set of the ink sheet and the image receiving sheet each separated is also included in the medium according to the invention.

The laser thermal transfer ink sheet preferably comprises a support, the light-heat conversion layer and the ink layer. The preferable laser transfer image receiving sheet comprises the thermoplastic resin layer and the image receiving layer capable of receiving a part of the ink layer of the ink sheet. The thermoplastic resin layer of the image receiving sheet contains a resin having a Vicat softening point of not more than 80° C. One of the image receiving layer of the image receiving sheet and the ink layer of the ink sheet contains a matting agent having a particle diameter larger than the thickness of the layer containing the particles and the projection height of the matting agent is less than 3.5 $\mu$m and the frequency of the projections is 400 to 4,000/mm$^2$.

Furthermore, it is more preferable that the laser thermal transfer ink sheet comprises a light-heat conversion layer and an ink layer which contains a thermoplastic resin having a dry bulb softening point of 60 to 150° C. in an amount of 65% to 95% by weight and has a layer thickness of from 0.52 g/m$^2$ to 0.52 g/m$^2$.

In the invention, the dry bulb softening point is determined by the method defined in JIS K-2531.

Examples of the resin having the dry bulb softening point of from 60 to 150° C. include ethylene copolymers, polyamide resins, polyester resins, polyurethane resins, polyolefin resins, acryl resins, vinyl chloride resins, cellulose resins, rosin resins, polyvinyl alcohol resins, polyvinyl acetal resins, ionomer resins, petroleum resins, polyvinyl butyral resins and resins for binder of ink layer described in JP O.P.I. No. 6-312583 each having a dry bulb softening point of from 60° to 150° C.

It is preferred that the dry bulb softening point is within the suitable range since a sufficient thermal transfer sensitivity can be obtained and a pressure fogging and blocking in the course of storage can be prevented. It is preferable that the layer has such the composition, since a sufficient thermal transfer sensitivity can be obtained and a coagulation destroying of the layer is not easily occurred compared with the layer mainly composed of a pigment.

In the invention, it is preferred that the ink layer contains the thermoplastic resin in an amount of from 65% to 95% by weight, and the thickness of the ink layer is within the range of from 0.52 g/m$^2$ to 0.90 g/m$^2$. It is preferable that the layer has such the composition, since a sufficient thermal transfer sensitivity can be obtained and breaking of the ink layer in the course of peeling is not easily occurred so that the stable peeling can be performed.

In the invention, it is preferable that the thermoplastic resin having a dry bulb softening point of from 60° to 150° C. comprises two or more kinds of resins and the difference of the softening point of the thermoplastic resin having the highest softening point and that of the thermoplastic resin having the lowest softening point is from 20° to 80° C. The resin having the high softening point gives a uniform transferring ability since the viscosity of fused resin at the time of heating by exposure, and the resin having the low softening point is effective for raising the thermal transfer sensitivity. Moreover, the combination use of resins different from each other in the softening point thereof causes lowering in the coagulate force of the ink layer at the boundary between the exposed area and unexposed area. Accordingly, the force necessary to peel off the ink sheet after exposure can be lowered, with the result that the peeling can be stably performed and the ink transfer with a uniform density can be carried out.

It is preferable that the difference of the softening points of the two resins is within the above-mentioned range since the uniform transfer and the peeling by a lowered force can be realized and the peeling can be performed stably.

In the invention, it is preferable that the ink layer contains a matting agent having a particle diameter larger than the thickness of the ink layer, and the projection height of the matting agent is less than 3.5 $\mu$m and the frequency of the projections is from 400/mm$^2$ to 4,000/mm$^2$.

Figure 2:
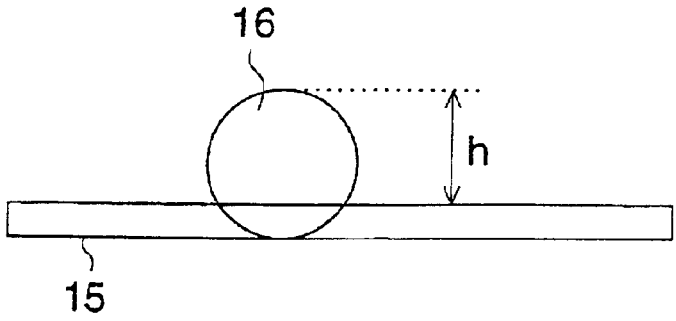

The projection height is a horizontal distance from the surface of the ink layer to the to of the matting agent. As shown in FIG. 2, the projection height h is the horizontal distance from the surface of ink layer 15 to the top of the matting agent 16. The projection height is measured by an optical method.

The frequency of the projections is measured by observing the image receiving surface by an optical microscope and counting the projections.

It is preferable that the projection height is within the above-mentioned range since the distance between the image receiving surface and the ink surface is controlled so as not to be excessively large with the result that a sufficient thermal transfer sensitivity can be easily obtained.

The contactness between the image receiving surface and the ink surface at the time of exposure and heating can be suitably maintained and a much sufficient thermal transfer sensitivity can be obtained by making the frequency of the projections is within the above-mentioned range. Moreover, adhesion of the ink layer with the light-heat conversion layer by thermal fusion is difficult to occur since a heat insulation effect is effective for stably performing the peeling development can be stably performed. Accordingly, the unevenness of image is reduced and the problem that the image receiving sheet is displace from the vacuum drum together with the ink sheet at the time of peeling can be prevented. Furthermore, a suitable vacuum contact at the central portion of the sheet can be obtained and the ink layer is further uniformly can be transferred.

In the invention, the Vicat viscosity is defined by JIS K-6760. It is not desirable that the Vicat softening point of the resin of the thermoplastic resin layer of the image receiving sheet exceeds to 80° C. since the transferring ability to a final image carrier such as paper by laminating is lowered.

Organic or inorganic fine particles are usable as the matting agent to be contained in one of the image receiving layer or the ink layer. Fine particles of a radical polymerized polymer such as polymethyl methacrylate (PMMA), polystyrene, polyethylene and polypropylene, and fine particles of a condensed polymerized polymer such as polyester and polycarbonate are usable as the organic matting agent.

Either the ink surface or the image receiving surface may be matted. An uniform contact can be obtained at the vacuum contacting can be obtained by addition of the matting agent to one of the image receiving layer and the ink layer, the matting agent has a diameter larger than the thickness of the layer. As a result of that, the unevenness of peeling can be reduced.

The critical effects of the projection height and the frequency of the projection by the matting particles are the same as the foregoing.

In another laser thermal transfer recording method according to the invention, a laser thermal transfer ink sheet comprising a light-heat conversion layer and an ink layer and a laser thermal transfer image receiving sheet comprising a thermoplastic resin layer are contacted by a vacuum, and a laser light is irradiated from the ink sheet side to thermally transfer the ink layer to the image receiving layer side by light-heat conversion, and then the ink sheet is peeled off from the image receiving sheet after heat is sufficiently released to form a transferred image on the image receiving sheet. In the above-mentioned, the resin composing the thermoplastic resin layer has a Vicat softening point of not more than 80° C., one of the image receiving layer and the ink layer contains a matting agent having a diameter larger than the thickness of the layer in which the matting agent is contained and the projection height of the matting agent is less than 3.5 $\mu$m and the frequency of the projection is from 400 to 4,000/mm$^2$. The peeling angle at the peeling of ink sheet and the image receiving sheet is regulated at an angle of from less than 30°.

The time for sufficiently releasing heat is preferably not less than 0.5 seconds, more preferably not less than 1 second, most preferably not less than 2 seconds after the exposure.

Figure 3:
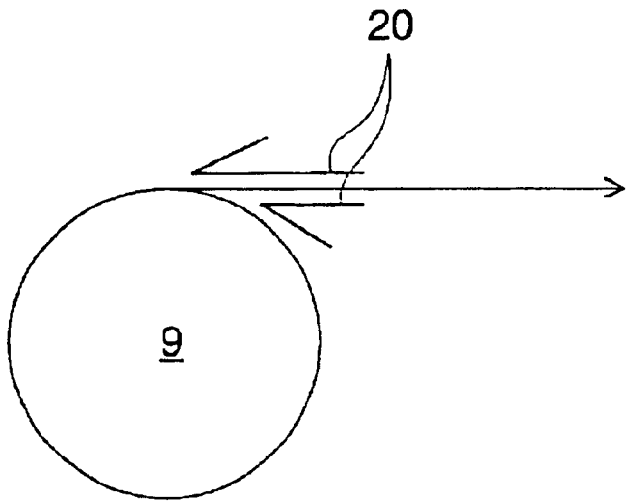
Figure 4:
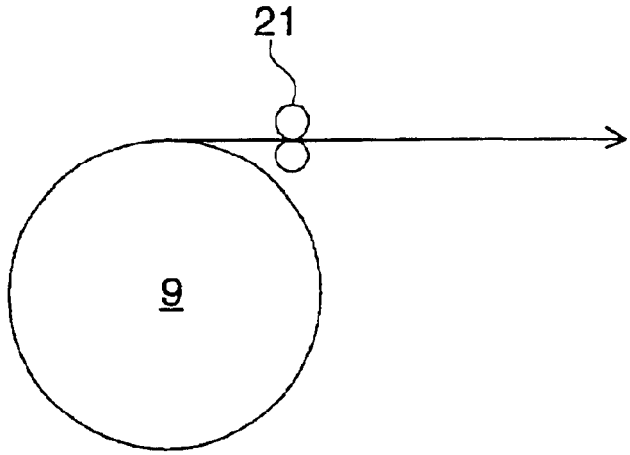

FIGS. 3 and 4 show the construction of the peeling device. In FIG. 3, 20 is a peeling guide arranged at an upper portion of the exposure drum 9. In the embodiment shown in FIG. 3, the peeling guides 20 are arranged at both sides along the peeling direction. However, the peeling guide may be arranged at only one side. In FIG. 4, 21 is a peeling roller arranged at an upper position of the exposure drum 9. It is preferred in the invention that the peeling of the image receiving sheet from the ink sheet is carried out by the use of the peeling roller and/or the peeling guide. In both figures, arrow shows peeling direction.

Figure 5:
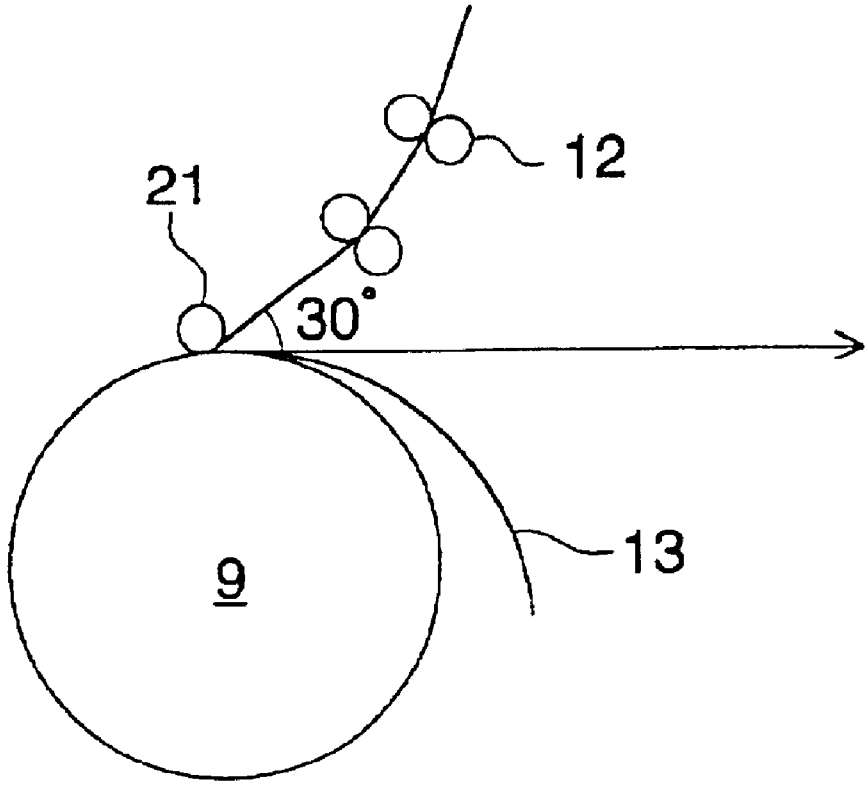

In the invention, the peeling angle is defined by the interior angle made by the direction of tangential line of the cylindrical drum with the transporting direction of the ink sheet in the peeling process. In FIG. 5, ink sheet 12 is peeled off from image receiving sheet 13 and the peeling angle thereof, or the angle of the tangential line of the drum to the ink sheet, is 30°.

When the ink sheet and the image receiving sheet are contacted by a vacuum on a pale and exposed to laser light, the peeling angle is an interior angle formed by the ink sheet and the plate.

It is preferred that the peeling angle is set at an angle of not more than 30° since the take out pass of the ink sheet after peeling can be simplified with the results that the simplification, size reduction and cost lowering of the apparatus can be realized. The peeling angle is preferably regulated by the peeling guide.

In the preferable embodiment of the method according to the invention, the thermoplastic resin having a dry bulb softening point of from 60 to 150° C. comprises a combination of two or more kinds of resins, and the difference between the softening point of the thermoplastic resin having the highest softening point and that of the thermoplastic resin having the lowest softening point is from 20 to 80° C.; and the ink layer contains a matting agent having the diameter larger than the thickness of the ink layer and the projection height of the matting agent is less than 3.5 $\mu$m and the frequency of the projections is from 400/mm$^2$ to 4,000/mm$^2$.

The laser thermal transfer image recording method, which is preferably employed in the invention, is a method in which laser beam is converted to heat and ink is transferred to the image receiving layer employing the heat energy to form an image on the image receiving sheet. The transferred image on the receiving sheet is transferred to final image carrier such as paper, and therefore, the receiving sheet is called intermediate transfer medium. The image transfer includes fusing transfer, ablation transfer or sublimation transfer.

Fusion transfer and ablation transfer are, inter alia, preferable as these method form image having similar hue to print image.

Ink Sheet

The ink sheet employed in the invention is a film having a light-heat conversion function and an ink transfer function, and is composed of at least light-heat conversion layer and an ink layer on a support, and cushion layer, peeling layer or adhesion layer may be provided between these layers and a support, when they are required.

For the support anyone having stiffness, good dimensional stability and fastness against heat at a time of image forming can be employed, and specifically, plastic film such as polyethyleneterephthalate, polyethylenenaphthalate, polycarbonate, nylon, polyvinylchloride, polystyrene, polymethylmethacrylate, polypropylene is cited.

The thickness of the support is preferably 50 to 100 $\mu$m in view of displaying the advantage of the invention.

The support is preferably transparent because laser is irradiated from the back side of the ink sheet to form an image. The support is also preferable to have adequate stiffness and flexibility for suitable transportation.

The ink layer in the laser fusing thermal transfer method is a layer capable of transferring itself accompanying a colorant and binder etc. contained in the layer, which is melted or softened when it is heated. The layer is not necessary to transfer in complete fused phase.

The colorant includes inorganic pigment (for example, titanium dioxide, carbon black, graphite, zinc oxide, Prussian blue, cadmium sulfate, iron oxide and a chromate of lead, zinc or barium), organic pigment (for example, azo compounds, indigo compounds, anthraquinone compounds, anthanthrone compounds, triphenodioxazine compounds, vat dye pigment, phthalocyanine pigment or its derivative, and quinacridone pigment) and dyes (for example, direct dyes, dispersion dyes, oil soluble dyes, metal-containing oil soluble dyes and sublimable dyes).

For example, as pigment for a color proof, C.I. 21095 or C.I. 21090 is used as a yellow pigment, C.I. 15850:1 as a magenta pigment, and C.I. 74160 as a cyan pigment.

The colorant content of the ink layer may be adjusted in such a manner that an intended content can be obtained based on the intended coating thickness, and not specifically limited. The colorant content of the ink layer is ordinarily 5 to 70% by weight, and preferably 10 to 60% by weight.

As the binder of the ink layer a thermoplastic resin having a dry bulb softening point of 60 to 150° C. is employed, and further a heat fusible compound and a heat softening compound can be employed.

The heat fusible compound is a solid or semi-solid compound having a melting point of 40 to 150° C., the melting point measured by means of a melting point apparatus, Yanagimoto JP-2, and includes waxes, for example, vegetable wax such as carnauba wax, Japan wax, or esparto wax, animal wax such as bees wax, insect wax, shellac wax or spemaceti, petroleum wax such as paraffin wax, microcrystalline wax, polyethylene wax, ester wax or acid wax, and mineral wax such as montan wax, ozocerite or ceresine. The binder further includes a higher fatty acid such as palmitic acid, stearic acid, margaric acid or behenic acid, a higher alcohol such as palmityl alcohol, stearyl alcohol, behenyl alcohol, margaryl alcohol, myricyl alcohol or eicosanol, a higher fatty acid ester such as cetyl palmitate, myricyl palmitate, cetyl stearate or myricyl stearate, an amide such as acetamide, propionic amide, stearic amide or amide wax, and a higher amine such as stearyl amine, behenylamine or palmityl amine.

In addition to the thermoplastic resin having a dry bulb softening point of 60 to 150° C., elastomers such as natural rubber, styrene-butadiene rubber, isoprene rubber, chloroprene rubber or a diene copolymer; rosin derivatives such as ester gum, a rosin-maleic acid resin, a rosin phenol resin or a hydrogenated rosin; a phenol resin, terpenes, a cyclopentadiene resin or aromatic hydrocarbon resins can be employed in combination in the present invention.

An ink layer having thermal transfer characteristics with desirable heat softening point or heat fusing point can be formed by selecting adequately above mentioned heat fusing substance and thermoplastic substance.

An image forming is possible by abrasion transfer by employing a binder having high thermally decomposing property in the present invention. Binder for the purpose is a polymer substance which causes rapid acid catalytic partial decomposition at temperature preferably not more than 200° C. measured in the equilibrium condition. Specific example includes nitrocellulose compounds, polycarbonate compounds, polymers reported in J. Image Science, 30(2), pp59–64 (1986) by J. M. J. Frechet, F. Bouchard, J. M. Houlihan, B. Kryczke and E. Eichler. Polyurethane compounds, polyester compounds, polyorthoester compounds and polyacetar compounds, and copolymer of these. These polymers are reported by a patent application of Holy et al as well as the decomposing mechanism in detail.

It is disclosed that an image with high density can be obtained by making grain size of pigment even in JP A 62-158092. Further, it is effective to employ various dispersion aids for the purpose of obtaining good dispersion property and good color reproduction.

Other examples of the additives include plasticizer which affect to obtain higher sensitivity by plasticizing the ink layer, surfactant which improves coating characteristics of ink layer, fine particles of submicron to micron level which prevent blocking of ink layer.

The thickness of the ink layer is preferably 0.2 to 2.0 $\mu$m, more preferably 0.3 to 0.7 $\mu$m in the present invention.

The light-to-heat converting compound is preferably a compound which absorbs light and effectively converts to heat, although different due to a light source used. For example, when a semi-conductor laser is used as a light source, a compound having absorption in the near-infrared light region is used. The near-infrared light absorbent includes an inorganic compound such as carbon black, an organic compound such as a cyanine, polymethine, azulenium, squalenium, thiopyrylium, naphthoquinone or anthraquinone dye, and an inorganic metal complex of phthalocyanine, azo or thioamide type. Specifically, the near-infrared light absorbent includes compounds disclosed in JP-A Nos. 63-139191, 64-33547, 1-160683, 1-280750, 1-293342, 2-2074, 3-26593, 3-30991, 3-34891, 3-36093, 3-36094, 3-36095, 3-42281, 3-97589 and 3-103476. These compounds can be used singly or in combination of two or more kinds thereof. Further, employed may be those in which the surface of carbon black is modified with a carboxyl group and sulfone group.

As the binder of the light-to-heat converting layer which works as the light-to-heat conversion layer, are used resins having high Tg and high heat conductivity. The binder includes common heat endurable resins such as polymethylmethacrylate, polycarbonate, polystyrene, ethylcellulose, nitrocellulose, polyvinylalcohol, polyvinyl chloride, polyamide, polyimide, polyetherimide, polysulfone, polyethersulfone, and aramide. Polythiophens, polyanilines, polyacetylenes, polyphenylene-sulfides, polypyrrole and polymers of derivatives therefrom or mixture thereof.

A water soluble polymer can be also used as a binder in the light-to-heat converting layer. The water soluble polymer is preferable because it gives excellent peelability between the image forming layer and the intermediate layer, has high heat resistance while irradiating light, restrains scatter or abrasion of the intermediate layer when excessive heat is applied. When the water soluble polymer is used, it is preferable that the light-to-heat converting compound is water soluble (by incorporation of a sulfo group to the compound) or dispersed in water. Furthermore, various types of releasing agents are preferably incorporated into the light-to-heat converting layer. By incorporating the releasing agent, the intermediate layer can give excellent peelability between the image forming layer and the intermediate layer and can improve sensitivity. The releasing agent includes a silicone releasing agent (for example, a polyoxyalkylene modified silicone oil or an alcohol modified silicone oil), a fluorine-containing surfactant (for example, a perfluoro phosphate surfactant, and other various surfactants.

The light-to-heat converting compound content of the light-to-heat converting layer may ordinarily be determined in such a manner that the layer gives an optical density of preferably 0.3 to 3.0, more preferably 0.7 to 2.5 to light wavelength emitted from a light source used. When carbon black is used in the light-to-heat converting layer which may serve as the peeling layer and the layer thickness is more than 1 $\mu$m, scorching due to excessive heating does not occurs but sensitivity tends to be lowered. The layer thickness is optionally selected due to power of a laser used or the optical density of the light-to-heat converting layer.

The thickness of the light-to-heat converting is preferably 0.05 to 0.6 $\mu$m.

As the light-heat converting layer, an evaporation layer may be used. The evaporation layer includes an evaporation layer of carbon black or metal black such as gold, silver, aluminum, chrome, nickel, antimony, tellurium, bismuth, or selenium described in JP-A No. 52-20842, as well as an evaporation layer of metal element of Ib, IIb, IIIa, IVb, Va, Vb, Via, VIb, VIIb and VIII groups in the period table or alloy thereof, and particularly preferable metal include Al, Bi, Sn, In, Zn or alloy of these, or alloy of these metal and element of Ia, IIa, and IIIb groups in the period table. Suitable metal oxide and metal sulfide include compounds of Al. Bi, Sn, In, Zn, Ti, Cr, Mo, W, Co, Ir, Ni, Pb, Pt, Cu, Ag, Au, Zr and Te, or mixture of these. Further, evaporation layer of metallophthalocyanine compounds, metallodithiolene compounds and anthraquinone compounds are cited.

The thickness of the evaporation layer is preferably less than 500 angstrom.

The light-heat converting substance may be a colorant in the ink layer itself, and various substances may be employed not restricted to those described above.

In case that the light-heat conversion layer is poor in adhesion to the support lower layer, turbidity by color mixture may happen at the occasion of peeling off the ink sheet from the intermediate transfer medium during the exposing to light or after thermal transferring. Therefore, it may be possible to provide an adhesion layer between the light-heat conversion layer and the support lower layer.

Adhesives such as polyester, urethane, gelatin etc. may be employed for the adhesive layer. Stick aids or adhesives may be added to the cushion layer in place of providing adhesive layer for obtaining the similar effect.

The cushion layer is provided for the purpose of increasing adhesion between the ink sheet and the intermediate transfer medium. The cushion layer is a layer having thermal softening property or elasticity, and materials which deform satisfactory by heat, or have low elasticity or gum elasticity, may be employed.

The thermal transfer image forming material mentioned above in which elastic modulus of the cushion layer is not more than 250 kg/mm$^2$ at 25° C. The penetration of the cushion layer is preferably 15 to 500 under the standard test conditions of JIS K2530-1976.

The cushion layer has dry bulb softening point of preferably not more than 70° C., and more preferably 50° C.

Specifically, the cushion layer is preferably comprised of components having thermoplasticity as a binder thereof. Such components include, for example, ethylene-vinyl acetate copolymers, ethylene-ethyl acrylate copolymers, polybutadiene resins, styrene-butadiene copolymers (SBR), styrene-ethylene-butene-styrene copolymers (SEBS), acrylonitrile-butadiene copolymers (NBR), polyisoprene resins (IR), styrene-isoprene (SIS), acrylic acid ester copolymers, polyester resins, polyurethane resins, acrylic resins, butyl rubber, polynorbornene, and the like.

Those having relatively low molecular weight are ready to satisfy the requirement of the invention, however, the preferable materials are not restricted to those because of depending on other element.

The additives other than the described above can also give preferable properties to the cushion layer. These additives include a low melting point compound such as wax and a plasticizer such as phthalate, adipate, a glycol ester, a fatty acid ester, a phosphate, and chlorinated paraffin. Additives as described in "Plastic oyobi gomu yo tenkazai jitsuyo binran (Practice Handbook of Additives to Plastic and Gum)", Kagaku Kogyosha (1970) can be used.

The addition amount of the additives may be an amount necessary to develop preferable properties with main components used in the cushion layer with no special limitations, but is preferably 10 weight %, more preferably 5 weight %, based on the total cushion layer weight.

The cushion layer is formed by means of a blade coater, a roller coater, a bar coater, a curtain coater or a gravure coater, or formed by laminating such as hot-melt extrusion laminating and further completed by coating to obtain smooth surface.

On the other hand, the special cushion layer can be formed by employing void structured resin which is prepared by foaming a heat fusible resin or a heat softening resin.

It is desirable to complete surface by coating in case of forming sealing cushion layer which requires smooth surface.

The thickness of the cushion layer is preferably 0.1 to 10 $\mu$m, and more preferably 0.3 to 7 $\mu$m.

Image Receiving Layer or Intermediate Transfer Medium

The image receiving sheet employed in the present invention (which may be referred to "intermediate transfer medium") is composed of image receiving layer provided on a support fundamentally. The preferable example is composed of a backing coat on one side of a support and a cushion layer and thereon an image receiving layer on the other side of the support.

The support may be any support, as long as it has excellent dimensional stability and heat resistance in forming an image. As the support is used, for example, a film or sheet disclosed on page 2, lower left column, lines 12 to 18 of JP-A No. 63-193886. The support has preferably stiffness or flexibility suitable for transport.

The thickness of the support is preferably 25 to 200 $\mu$m, and more preferably 50 to 125 $\mu$m.

The binder used in the back coat layer includes a polymer such as gelatin, polyvinyl alcohol, methylcellulose, nitrocellulose, acetylcellulose, an aromatic polyamide resin, a silicone resin, an epoxy resin, an alkyd resin, a phenol resin, a melamine resin, a fluorine-containing resin, a polyimide resin, a polyurethane resin, an acryl resin, a urethane modified silicone resin, a polyethylene resin, a polypropylene resin, Teflon, a polyvinyl butyral resin, a polyvinyl chloride resin, polyvinyl acetate, polycarbonate, an aromatic polyester, a fluorinated polyurethane or polyether sulfone.

It is effective for prevention of separation of the matting agent from the back coat layer or improved anti-scratch of the back coat layer to use a cross-linkable water soluble binder in the back coat layer and cross-link the binder. It is also effective for blocking during storage.

According to characteristics of a cross-linking agent used, the cross-linking is carried out by heat, an active ray, pressure or its combination but with no special limitations. An adhesive layer may be provided between the back coat layer and the support to give an adhesion property to the support.

The matting agent preferably used in the back coat layer includes organic or inorganic fine particles. The organic matting agent includes fine particles such as polymethyl methacrylate (PMMA), polystyrene, polyethylene, polypropylene or other radical polymerization polymers and polycondensation polymer fine particles such as polyesters and polycarbonates.

The coating weight of the back coat layer is preferably 0.5 to 3 g/m$^2$. In the range, coating characteristics are stable and matting particles are fixed, and gives clear image without unevenness etc.

The number average particle size of the matting agent is preferably 2.5 $\mu$m or more, and more preferably 2.5 to 20 $\mu$m, larger than the thickness of the back coat layer containing only a binder resin. The back coat layer containing a matting agent having a particle size of 8 $\mu$m or more in an amount of 5 mg/m$^2$, preferably 6 to 600 mg/m$^2$ minimizes foreign matter problems. It has been proved that the matting agent having a value obtained by dividing standard deviation by the number average particle size, $\sigma/r_n$ (variation coefficient of particle size) of 0.3 or less, which has a narrow particle size distribution, solves a problem which occurs is caused by a matting agent of too large particle size and further can attain an intended object in a small amount. The variation coefficient is more preferably 0.15 or less.

The back coat layer preferably contains an anti-static agent in order to prevent foreign matter adherence due to frictional electrification caused during contact with a transport roller. The anti-static agent includes a cationic, anionic or nonionic surfactant, a polymer anti-static agent, conductive fine particles and compounds described on pages 875 and 876 of "11290 Kagaku Shohin" (1290 Chemical Items), Kagakukogyo Nipposha.

An anti-static agent preferably used in the back coat includes conductive fine particles such as carbon black, metal oxides, for example, zinc oxide, titanium oxide, or tin oxide, and organic semiconductors. Particularly, the conductive fine particles are free from separation from the layer and give a stable anti-static effect independent of ambient atmosphere.

The back coat layer may contain various surfactants, silicone oil or a fluorine-containing resin in order to have a releasing or coating property.

The back coat layer in the invention preferably has a softening point of 70° C. or less, the softening point being measured according to a TMA (Thermo Mechanical Analysis) method.

The TMA softening point is measured by heating a sample at a constant temperature elevating speed while applying a constant load to the sample and then observing the sample phase. In the invention, a temperature at which the sample phase begins varying is defined as a TMA softening point. The measurement of a softening point according to TMA can be conducted employing Thermoflex made by Rigaku Denki Co. Ltd.

The cushion layer (thermoplastic layer) in the intermediate transfer medium is provided by the same material as that employed in the ink sheet. The thermoplastic layer comprises a resin having Vicat softening point not more than 80° C. The thickness of the cushion layer is preferably 5 to 40 $\mu$m, more preferably 10 to 30, and particularly preferably 15 to 25 $\mu$m.

Close contact of the intermediate transfer medium with the ink sheet is improved by providing the thermoplastic layer, and as the result, retransfer to the final recording medium such as paper can be improved.

The image receiving layer which constitutes the intermediate transfer medium is described. The image receiving layer is composed of a binder and various additives employed in case of necessity.

The TMA softening point of the image receiving layer is preferably 70° C. or less, and more preferably 60° C. or less.

The image receiving layer contains a binder resin and a matting material, and optionally various additives. The resin used in the image receiving layer includes an adhesive such as a polyvinyl acetate emulsion type adhesive, a chloroprene emulsion type adhesive or an epoxy resin type adhesive, a tackifying agent such as a natural rubber, chloroprene rubber, butyl rubber, polyacrylate, nitrile rubber, polysulfide, silicone rubber or a petroleum resin, a reclaimed rubber, a polyvinylchloride resin, SBR, polybutadiene resin, polyisoprene, a polyvinyl butyral resin, polyvinyl ether, an ionomer resin, SIS, SEBS, an acryl resin, an ethylene-vinyl chloride copolymer, an ethylene-acryl copolymer, an ethylene-vinyl acetate resin (EVA), a vinyl chloride grafted EVA resin, an EVA grafted vinyl chloride resin, a vinyl chloride resin, various modified olefins and polyvinyl butyral.

The binder thickness of the image receiving layer is preferably 0.8 to 3.0 μm, more preferably 0.8 to 2.5 μm.

The intermediate transfer medium may have a peeling layer between the image receiving layer the cushion layer. The peeling layer if particularly effective when the image receiving layer having formed an image from the intermediate transfer medium is transferred to final support.

The binder of the releasing layer includes polyester, polyvinyl acetal, polyvinyl formal, polyparabanic acid, polymethylmethacrylate, polycarbonate, ethylcellulose, nitrocellulose, methylcellulose, carboxymethylcellulose, hydroxypropylcellulose, polyvinyl alcohol, polyvinyl chloride, polystyrene, acrylonitrile styrene or their cross-linked polymers, a heat hardenable resin having a Tg of 65° C. or more such as polyamide, polyimide, polyetherimide, polysulfone, polyethersulfone or aramide or their hardened resin. The cross-linking agent includes a conventional one such as isocyanate or melamine.

The binder of the releasing layer is preferably polycarbonate, acetal, or ethylcellulose in view of storage stability, and it is more preferable that when an acryl resin is used in the image receiving layer, releasing is excellent in re-transferring an image transferred after a laser heat transfer.

A layer whose adhesion to the image receiving layer becomes poor in cooling can be used as a releasing layer. Such a layer is, for example, a layer containing a heat fusible compound such as waxes or a heat fusible compound and thermoplasticizer for the binder.

The heat fusible compound includes compounds disclosed in JP-A No. 63-193886, and microcrystalline wax, paraffin wax or carnauva wax is preferably used. As the thermoplasticizer, an ethylene copolymer such as ethylene-vinyl acetate copolymer or a cellulose resin is preferably used.

As an additive, a higher fatty acid, a higher alcohol, a higher fatty acid ester, an amide or a higher amine is optionally added to the releasing layer.

Another releasing layer is a layer which is melted or softened while heating, resulting in cohesive failure and is released. Such a layer preferably contains a supercooling agent. The supercooling agent includes poly-e-caprolactam, polyoxyethylene, benzotriazole, tribenzylamine and vanillin.

Still another releasing layer may contain a compound lowering adhesiveness to the image receiving layer. The compound includes a silicone resin such as silicone oil, a fluorine-containing resin such as Teflon or a fluorine-containing acryl resin or a polysiloxane resin, an acetal resin such as polyvinyl butyral, polyvinyl acetal, polyvinyl formal, solid wax such as polyethylene wax or amide wax, a fluorine-containing surfactant and a phosphate surfactant.

The releasing layer is formed by dissolving or dispersing the compounds described above in a solvent and coating the resulting solution or dispersion on the cushion layer by means of a blade coater, a roller coater, a bar coater, a curtain coater or a gravure coater, or by hot-melt extrusion laminating. Further, the releasing layer can be formed by coating the resulting solution or dispersion on a temporary support, laminating the coated on the cushion layer, and then peeling the temporary support.

The thickness of the releasing layer is preferably 0.3 to 3.0 μm. When the releasing layer is too thick, property of the cushion layer is difficult to develop, and the thickness need be adjusted according to kinds of the releasing layer.

EXAMPLES

The invention will be explained by the following. In the examples, "parts" is parts by weight, unless otherwise specified.

Example 1

Preparation of Ink Sheet Samples Y1, Y2 and Y3

The following composition of the intermediate layer was coated by means of a reverse roll coater on a 100 μm thick polyethylene terephthalate (PET) film support (T-100G, #100 made by Diafoil Hoechst Co.) and dried to give an intermediate layer having a dry thickness of 7 μm. Then, before winding the following composition of a light-heat converting layer was coated by means of wire bar coating, and dried to provide the light-heat converting layer. The dry coating amount of the light-heat converting layer was 0.6 g/m$^2$.

Intermediate Layer Coating Composition

Styrene/ethylene/butadiene/styrene resin (Kraiton G1657, made by Shell Chemical Co.) 14 parts Tackifier (Super Ester A100, made by Arakawa Chemical Co.) 6 parts Methylethylketone 10 parts Toluene 80 parts Light-Heat Converting Layer Composition PVA (Gosenol EG-30, made by Nippon Gousei Kagaku Co.)

6 parts

Carbon black dispersion (SD-9020, Dainippon Ink Kagaku Co.) 4 parts (Solid parts converted amount)

Water 490 parts

The following composition of a light-heat converting layer was coated by means of wire bar coating on a reverse side of the light-heat converting layer coating side to obtain a backing coat layer with dry amount of 0.6 g/m$^2$. Then, before winding, the following composition of an ink layer which was prepared by dispersion method was coated by means of wire bar coating, and dried to provide ink layer so as to have dry coating amount described in Table 1 and the Ink Sheet Samples Y1, Y2 and Y3 were prepared.

Backing Coat Layer Composition

Polyester resin (Byron200, made by Toyobo Co.) 9.6 parts

Silicone oil (X-24-8300, made by Shin-etsu Kagaku Co.) 0.1 parts

Methylethylketone 36 parts

Cyclohexanone 36 parts

Toluene 18 parts

Ink Layer Composition

Yellow pigment dispersion (Disazo yellow 1316, Noma Kagaku Ind., Co.) shown in Table 1

Thermoplastic Resin

Styrene/acryl resin (Highmer SBM-73F, made by Sanyo Kasei Co., dry bulb softening point of 120° C.) shown in Table 1

F-178K (DIC) 0.5 parts

Methylethylketone 570 parts

Cyclohexanone 1330 parts

TABLE 1

Ink layer coating composition

| | Yellow Pigment | Dispersant Polyester | SBM-73F s.p.:120° C. | EV-40Y s.p.:98° C. | Coating amount (g/m$^2$) |
|---|---|---|---|---|---|
| Y1 | 27.0 | 5.5 | 63.8 | 3.2 | 0.54 |
| Y2 | 27.0 | 5.5 | 63.8 | 3.2 | 0.52 |
| Y3 | 27.0 | 5.5 | 63.8 | 3.2 | 0.48 |

Color decision receiving film CD-1R (made by Konica Corporation) was employed as a standard sample of the image receiving sheet (a recording medium to be transferred). CD-1R comprises a thermoplastic resin layer of about 30 $\mu$m in addition to an image receiving layer, and contains a matting agent at the image receiving surface, projection height being 2.7 $\mu$m and the frequency being about 1,200/m$^2$.

Recording and Evaluation

Several patterns were exposed on the color decision receiving film CD-1R employing Konica EV-laser Proofer (laser oscillating wavelength is 830 nm, circumferential length is 29 inches) at illumination intensity of an exposed portion of 70 to 100 mW/1ch and rotational rate of 400 to 600 rpm.

The samples were subjected to peeling developing so that the peeling is conducted to make tangential direction with reference to the drum, (i.e., peeling angle being 0°), the image receiving sheet having transferred ink was transferred to an art paper by means of EV-laser-laminator, and final image was obtained.

Evaluation

Samples were evaluated in the following way and criteria. The result is shown in Table 2.

In Table 2 A to F each denotes the following.

A: Sensitivity. Maximum rotation number to give constant solid density. (The larger number shows higher sensitivity.)

B: Ablation point. Maximum rotation number at which the light-heat conversion layer scatters to make the image dirty. (The smaller number is more preferable.)

C: Uniformity of image (Uneven peeling). 175 lines, 50% screen tint image was printed in A2 size, and unevenness of image density was observed. No uneven image is found: rank A. Slight uneven image is found: rank B. Obvious uneven image is found: rank C.

D: Uniformity of image (ink transfer characteristics) Uniformity of transferred solid image was estimated. Uneven image caused by incomplete transfer parallel to scanning direction. No uneven image found: rank A. Slight uneven image found: rank B. Obvious uneven image found: rank C.

E: Transfer ratio by laser. Ratio of amount of transferred ink to total ink amount of ink layer.

F: Transfer jamming. The image receiving sheet does not rise from the drum; rank A. There is no problem in peeling, but the image receiving sheet rises; rank B. The image receiving sheet drifts from the drum; rank C.

In the above, rank C is not practically acceptable.

TABLE 2

| No. | A (rpm) | B (rpm) | C | D | E (%) | F |
|---|---|---|---|---|---|---|
| Y1 | 470 | 400 | A | A | 96 | A |
| Y2 | 460 | 400 | A | A | 95 | A |
| Y3 | 430 | 420 | B | C | 90 | B |

Example 2

Ink sheets M1 to M7 were prepared in the same way as Example 1, except that the pigment, dispersing agent and thermoplastic resin and coating amount shown in Table 3 were employed in place of Ink Sheet Y1.

TABLE 3

| | Magenta Pigment | Polyester dispersing agent | Resin A (High s.p.) | Resin B (Low s.p.) | Coating amount (g/m$^2$) |
|---|---|---|---|---|---|
| M1 | 28.0 | 5.5 | 62.2 SBM73F | 3.8 EV40Y | 0.61 |
| M2 | 28.0 | 5.5 | 66.0 SBM73F | 0.0 | 0.61 |
| M3 | 28.0 | 5.5 | 44.0 TB1000 | 22.0 SBM73F | 0.61 |
| M4 | 28.0 | 5.5 | 44.0 TB1000 | 22.0 SBM100 | 0.61 |
| M5 | 28.0 | 5.5 | 33.0 SBM73F | 33.0 SBM100 | 0.61 |
| M6 | 28.0 | 5.5 | 44.0 SBM73F | 22.0 ST95 | 0.61 |
| M7 | 28.0 | 5.5 | 22.0 SB130 | 44.0 SBM100 | 0.61 |

In Table 3, the thermoplastic resins and its dry bulb softening point, resin composition and manufacturer are shown. Magenta pigment is Brilliant carmine 613, manufactured by Noma Kagaku Ind., Co.

Thermoplastic Dry bulb Resin

| Resin | Softening Point ° C. | composition (Manufacturer) |
|---|---|---|
| SBM100 | 104 | Styrene/Acryl resin (Sanyo Kasei Co.) |
| SBM73F | 120 | Styrene/Acryl resin (Sanyo Kasei Co.) |
| TB1000 | 145 | Styrene/Acryl resin (Sanyo Kasei Co.) |
| ST95 | 95 | Styrene resin (Sanyo Kasel Co.) |
| SB130 | 128 | Styrene resin (Sanyo Kasei Co.) |

-continued

| Resin | Softening Point ° C. | composition (Manufacturer) |
|---|---|---|
| EV40Y | 98 | Ethylene/vinylacetate resin (Mitsui DuPont Polychemical Co.) |

The evaluation was the same as Example 1, and the result is shown in Table 4.

TABLE 4

| No. | A | B | C | D | E | F |
|---|---|---|---|---|---|---|
| M1 | 480 rpm | Not more than 400 rpm | A | A | 96% | A |
| M2 | 480 rpm | Not more than 400 rpm | A | B | 92% | A |
| M3 | 460 rpm | Not more than 420 rpm | A | A | 98% | A |
| M4 | 470 rpm | Not more than 420 rpm | A | A | 92% | A |
| M5 | 510 rpm | Not more than 400 rpm | A | B | 93% | A |
| M6 | 500 rpm | Not more than 400 rpm | A | A | 98% | A |
| M7 | 500 rpm | Not more than 400 rpm | A | B | 92% | A |

Example 3

An image receiving sheet was prepared. EV40Y (described before, Vicat s. p. being not more than 40° C.) dissolved in toluene was coated so as to have dry thickness of 25 μm on a support of PET film having 100 μm thickness, then, ethylcellulose dissolved in isopropyl alcohol was coated thereon and dried to obtain dry thickness of 1.7 g/m$^2$.

An image receiving layer was provided by coating mixture of 95 parts of acryl latex (Yodozol A-5805, manufactured by Nihon NC) and 5 parts of fluorine resin (SumirazeResin FP150, manufactured by Sumitomo Chemical) so as to obtain dry thickness of 1.3 g/m$^2$. The mixture ratio is based on the ratio of solid composition. The sample was denoted as R1.

Ink sheet M8 was prepared in the same way as Example 2 except that 3 parts by weight of matting agent Tospearl 120 (manufactured by Toshiba Silicone, mat diameter 2.0 mm)

In M8 projection of the matting agent from the ink layer was 1.5 μm, the frequency of the matting particles were about 3,000/mm$^2$.

In the similar way, M9 was prepared by employing 6 parts by weight of matting agent MX500, manufactured by Soken Kagaku, diameter of 5.0 μm.

In M9 projection of the matting agent from the ink layer was 4.5 μm, the frequency of the matting particles were about 400/mm$^2$.

The ink sheets of M8 and M9 were tested in combination with the image receiving sheet mentioned above on exposure and peeling as Examples 1 and 2. Peeling test was further conducted in a way as the ink sheet was peeled while contacting a peeling roller having 1 inch diameter to drum. In case that the ink sheet was peeled in tangential direction to the drum, the peeling angle is 0°, and in case of employing the peeling roller the angle is 30° or more.

The results are shown in Table 5.

TABLE 5

| No. | Peeling | A | B | C | D | E | F |
|---|---|---|---|---|---|---|---|
| M8 | Tangential to Drum | 480 rpm | Not more than 400 rpm | A | A | 96% | A |
| M9 | Tangential to Drum | 430 rpm | 500 rpm | A | C | 85% | A |
| M8 | Peeling Roller | 500 rpm | Not more than 400 rpm | A | A | 96% | A |
| M9 | Peeling Roller | 440 rpm | 480 rpm | A | C | 88% | A |

The Table demonstrates that the present invention is advantageous to obtain good results, even in the case of peeling angle is less than 30° in which the peeling is difficult, not only the case of the angle is 30° or more.

Example 4

Image receiving sheet R2 was prepared in the same way as Example 3 except that the image receiving layer was modified in the following composition.

R2 Image Receiving Layer Composition

| | |
|---|---|
| Yodozol A-5805 | 91 wt parts |
| SumirazeResin FP150 | 5 wt parts |

MX40S-1, manufactured by Soken Kagaku, diameter of 3.9 μm. 4 wt parts

Weight parts is based on the solid parts weights.

In the image receiving layer the coating amount is 1.3 g/m$^2$, projection of the matting agent was 2.6 μm, the frequency of the matting particles were about 1,200/mm$^2$.

Image receiving sheet R3 was prepared in the same way as Example 3 except that the composition and coating amount were modified as follows.

R3 Image Receiving Layer Composition

| | |
|---|---|
| Yodozol A-5305 | 91 wt parts |
| SumirazeResin FP150 | 5 wt parts |

MX500, manufactured by Soken Kagaku, diameter of 5 μm. 4 wt parts

Weight parts is based on the solid parts weights.

In the image receiving layer the coating amount is 1.0 g/m$^2$, projection of the matting agent was 4.0 μm, the frequency of the matting particles were about 570/mm$^2$.

Estimation was made with variation of peeling condition as Example 3, by employing ink sheet M1. The results are shown in Table 6.

TABLE 6

| No. | Peeling | A | B | C | D | E | F |
|---|---|---|---|---|---|---|---|
| R2 | Tangential to Drum | 500 rpm | Not more than 400 rpm | A | A | 96% | A |
| R3 | Tangential to Drum | 480 rpm | 460 rpm | A | C | 90% | A |

TABLE 6-continued

| No. | Peeling | A | B | C | D | E | F |
|---|---|---|---|---|---|---|---|
| R2 | Peeling Roller | 500 rpm | Not more than 400 rpm | A | A | 96% | A |
| R3 | Peeling Roller | 480 rpm | 450 rpm | A | C | 91% | A |

The Table demonstrates that the present invention is advantageous to obtain good results, even in the case of peeling angle is less than 30° in which the peeling is difficult, not only the case of the angle is 30° or more.

Further, it is possible to make the exposure apparatus simple and compact with lower cost, because outlet pass of the ink sheet after peeling can be made simple without complication.

According to the invention, an ink sheet, a recording medium and a recording method for laser thermal transfer recording can be provided by which peeling for development can be stably carried out within a relative wide range of the peeling condition within a relative broad region.

Disclosed embodiment can be varied by a skilled person without departing from the spirit and scope of the invention.

What is claimed is:

1. A laser thermal transfer recording method comprising the steps of superposing a laser thermal transfer ink sheet having a light-heat conversion layer and an ink layer on a laser thermal transfer image receiving sheet having a thermoplastic layer and an image receiving layer;

contacting with a vacuum a surface of the ink layer of the ink sheet with the surface of the image receiving layer of the image receiving sheet;

thermally transferring a part of the ink layer to the image receiving layer by light-heat conversion of laser light irradiated from the ink layer side; and peeling off the ink sheet from the image receiving sheet, wherein Vicat softening point of the resin of the thermoplastic layer is not more than 80° C., and one of the image receiving layer and the ink layer contains a matting agent having a particle diameter larger than the thickness of the layer containing matting agent, the projection height of the matting agent is less than 3.5 $\mu$m and the frequency of the projections is from 400/mm$^2$ to 4,000/mm$^2$, and peeling angle of the ink sheet and the image receiving sheet is controlled at an angle less than 30°.

2. The laser thermal transfer recording method of claim 1, wherein the laser thermal transfer ink sheet and the laser thermal transfer image receiving sheet are superposed on a drum, laser light is irradiated in the condition of superposed state on the drum, and the peeling angle is an angle between tangential direction of the drum and direction of the ink sheet during peeling.

3. The laser thermal transfer recording method of claim 1, wherein the ink layer comprises a thermoplastic resin having a dry bulb softening point of from 60 to 150° C. in an amount of 65% to 95% by weight and a thickness of the ink layer is 0.3 to 0.7 $\mu$m.

4. The laser thermal transfer recording method of claim 3, wherein the ink layer comprises at least two kinds of thermoplastic resin having a dry bulb softening point of from 60 to 150° C. and difference of the softening point of thermoplastic resin having the highest softening point and that of thermoplastic resin having the lowest softening point is from 20° to 80° C.

* * * * *